US006216848B1

(12) United States Patent
Zens

(10) Patent No.: US 6,216,848 B1
(45) Date of Patent: Apr. 17, 2001

(54) VACUUM TABLE CONVEYING APPARATUS AND ASSOCIATED METHODS

(75) Inventor: Rene Zens, York (CA)

(73) Assignee: Profold, Inc., Sebastian, FL (US)

( * ) Notice: Subject to any disclaimer, the term of this patent is extended or adjusted under 35 U.S.C. 154(b) by 0 days.

(21) Appl. No.: 09/289,008

(22) Filed: Apr. 9, 1999

(51) Int. Cl.[7] ..... B26D 7/20; B65H 20/10
(52) U.S. Cl. ..... 198/689.1; 198/813; 198/841
(58) Field of Search ..... 198/689.1, 813, 198/841

(56) References Cited

U.S. PATENT DOCUMENTS

| | | | | |
|---|---|---|---|---|
| 2,895,593 | * | 7/1959 | McKnight et al. | 198/841 |
| 2,912,722 | * | 11/1959 | Howell | 198/841 |
| 3,843,253 | * | 10/1974 | Mikan et al. | 355/29 |
| 3,880,274 | * | 4/1975 | Bechtloff et al. | 198/626.2 |
| 4,206,994 | * | 6/1980 | Silverberg et al. | 198/841 |
| 4,322,993 | * | 4/1982 | Stumpf | 198/689.1 |
| 4,530,632 | * | 7/1985 | Sela | 198/689.1 |
| 4,651,984 | * | 3/1987 | Emrich | 198/689.1 |
| 4,925,009 | * | 5/1990 | Hill | 198/641 |
| 5,164,241 | * | 11/1992 | Andre De La Porte et al. | 428/97 |
| 5,234,097 | * | 8/1993 | Okuyama | 198/689.1 |
| 5,482,266 | * | 1/1996 | Takemoto et al. | 198/813 |
| 5,553,536 | * | 9/1996 | Van Os | 101/44 |
| 5,699,707 | * | 12/1997 | Campbell, Jr. | 198/689.1 |
| 5,881,860 | * | 3/1999 | Zecchi et al. | 198/689.1 |
| 5,904,240 | * | 5/1999 | Pax et al. | 198/841 |
| 5,971,134 | * | 10/1999 | Tref et al. | 198/689.1 |
| 6,044,959 | * | 4/2000 | Monsees | 198/689.1 |

FOREIGN PATENT DOCUMENTS

| | | | | |
|---|---|---|---|---|
| 24 56 047 | | 6/1975 | (DE) | B65H/2/22 |
| 3626244 | * | 2/1988 | (DE) | 198/689.1 |
| 0 075 685 A1 | | 8/1982 | (EP) | B65H/5/22 |
| 0 771 652 A2 | | 5/1997 | (EP) | B41J/2/01 |
| 0 888 992 A2 | | 1/1999 | (EP) | B65H/11/00 |
| 0 891 937 A1 | | 1/1999 | (EP) | B65H/20/10 |
| WO 97/09253 | | 3/1997 | (WO) | B65G/17/46 |

* cited by examiner

*Primary Examiner*—Robert P. Olszewski
*Assistant Examiner*—Paul T. Chin
(74) *Attorney, Agent, or Firm*—Allen, Dyer, Doppelt, Milbrath & Gilchrist, P.A.

(57) ABSTRACT

A vacuum table conveying apparatus and associated methods are provided. The apparatus preferably includes a frame, a vacuum chamber positioned to extend along an upper portion of the frame, a vacuum source positioned in fluid communication with the vacuum chamber to apply a low vacuum with a high volume of air to the vacuum chamber, and at least one vacuum belt overlying the vacuum chamber. The at least one vacuum belt preferably has a plurality of openings extending through upper and lower surfaces thereof so that vacuum from the vacuum chamber extends through the plurality of openings and applies to articles mounted on the upper surface of the at least one vacuum belt. A method of conveying articles preferably includes providing a low vacuum and high volume air source in fluid communication with a vacuum chamber, positioning at least one conveyor belt having a plurality of openings extending therethrough to overlie the vacuum chamber and in fluid communication with the vacuum source, and positioning a plurality of articles on the at least one conveying belt to be held in position by the vacuum applied through the plurality of openings from the vacuum chamber.

34 Claims, 4 Drawing Sheets

VACUUM TABLE CONVEYING APPARATUS AND ASSOCIATED METHODS

FIELD OF THE INVENTION

The invention relates to the field of article handling and, more particularly, to the field of handling articles for transporting or conveying during various industrial processing.

BACKGROUND OF THE INVENTION

Over the years, various article, e.g., mail, feeding, handling, sorting, and transporting systems have been developed for feeding, handling, sorting, and transporting pieces of mail. Within the field of article handle, one source of bottleneck and other handling problems has been the transporting of the articles along a surface. For example, know article conveying systems often have unstable platforms and may have an arcuate sectional profile whereby medial portions of a conveyor belt are often arcuate. This unstable platform and arcuate profile, however, can make printing on a surface of an article, e.g., a mail item, paper, or cardboard material, difficult. The results can be a distortion in the surface or ink as the ink from a printer is being applied. This, in turn, can cause irregularities within the printed image, poor image quality, and poor image resolution. Accordingly, there is a need for a more stable conveyor system which allows articles to be handled and transported effectively and allows printing on the surface of the article with minimal irregularities, high quality, and high resolution in the printed image.

SUMMARY OF THE INVENTION

In view of the foregoing background, the present invention advantageously provides a vacuum table conveying apparatus and associated methods which provide a stable conveying platform for articles mounted thereon. The present invention also advantageously provides a vacuum table conveying apparatus having a substantially flat belt conveying surface so that printer heads can easily be positioned closely adjacent the flat surface to thereby enhance image quality and resolution of images printed on surfaces of articles being conveyed therealong. The present invention additionally provides a vacuum table conveying apparatus and associated methods which has a high volume of air under a low vacuum pressure to enhance the holding power and the uniformity of the conveying of articles positioned thereon. The present invention further advantageously provides a vacuum table conveying apparatus and associated methods which allows air to move with the articles positioned thereon at substantially the same speed and which has a vacuum chamber substantially impervious to leaks.

More particularly, the present invention provides a vacuum table conveying apparatus which preferably includes a frame, a vacuum chamber positioned to extend along an upper portion of the frame, vacuum forming means positioned in fluid communication with the vacuum chamber to apply a low vacuum with a high volume of air to the vacuum chamber, and at least one vacuum belt overlying the vacuum chamber. The at least one vacuum belt preferably has a plurality of openings extending through upper and lower surfaces thereof so that vacuum from the vacuum chamber extends through the plurality of openings and applies to articles mounted on the upper surface of the at least one vacuum belt.

The vacuum forming means, for example, is preferably provided by a vacuum source which has a plurality of fans positioned in fluid communication with the vacuum chamber for applying a low vacuum with a high volume of air to the vacuum chamber. The apparatus also preferably has a plurality of spaced-apart rollers mounted to the frame, and the at least one vacuum belt is preferably mounted to and extending between the plurality of spaced-apart rollers and overlying the vacuum chamber. The apparatus additionally preferably has at least one drive connected to the frame for driving the plurality of rollers to thereby drive the at least one vacuum belt mounted thereon and convey articles mounted on the at least one vacuum belt in a predetermined direction of travel.

For enhanced stability of the table platform, e.g., belt and upper portions of the frame, each of the plurality of spaced-apart rollers preferably includes a roller channel formed in an outer surface of the roller. The at least one vacuum belt, in turn, preferably includes a belt stability protrusion extending outwardly from a medial portion of a lower surface of the at least one vacuum belt and positioned within each of the roller channels to thereby provide enhanced stability in the at least one vacuum belt when being driven by the plurality of rollers.

A vacuum table conveyor belt is additionally provided according to the present invention and preferably is formed by a combination of a first low friction web material layer, a second plastic material layer overlying the first low friction web material, and a belt stability protrusion connected to and extending outwardly from a medial portion of the first low friction web material layer. The belt stability protrusion is preferably positioned to abuttingly contact a drive roller and preferably has peripheries having a vertical sectional view thereof which define a substantially frusto-conical shape or another substantially V-shape.

The present invention also includes a method of conveying articles. The method preferably includes providing a low vacuum and high volume air source in fluid communication with a vacuum chamber, positioning at least one conveyor belt having a plurality of openings extending therethrough to overlie the vacuum chamber and in fluid communication with the vacuum source, and positioning a plurality of articles on the at least one conveying belt to be held in position by the vacuum applied through the plurality of openings from the vacuum chamber.

The present invention further provides a method of printing on conveyed articles. This method preferably includes providing a low vacuum and high volume air source in fluid communication with a vacuum chamber, positioning at least one substantially flat conveyor belt having a plurality of openings extending therethrough to overlie the vacuum chamber and in fluid communication therewith, positioning a plurality of articles on the at least one conveying belt to be held in position by the vacuum applied through the plurality of openings from the vacuum chamber, driving the at least one conveying belt in a predetermined direction, sensing the presence of articles positioned on the at least once conveyor belt, and positioning a head of a printer closely adjacent an upper surface of the substantially flat conveyor belt.

The combination of additional table platform stability, the enhanced vacuum which provides a uniform vacuum force and a strong holding force, and the substantially flat belt surface allow the vacuum table conveying apparatus to greatly enhance performance and handling quality of items such as mail, paper, books, or other material being transported therealong. The apparatus, for example, can advantageously be used for high speed transport and printing applications such as labels or other indicia on mail items. In such applications, high resolution ink jet requires an extremely stable platform, both in vertical and horizontal planes, as well as a constant speed. The paper or mail items, in turn, need to move on a substantially flat surface and very close to the ink jet printer head. If the surface is not substantially flat, then the particles or drops of ink being emitted from the ink jet head tend to be elliptical in formation and cause poor resolution or other quality problems.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

Figures 1, 2:
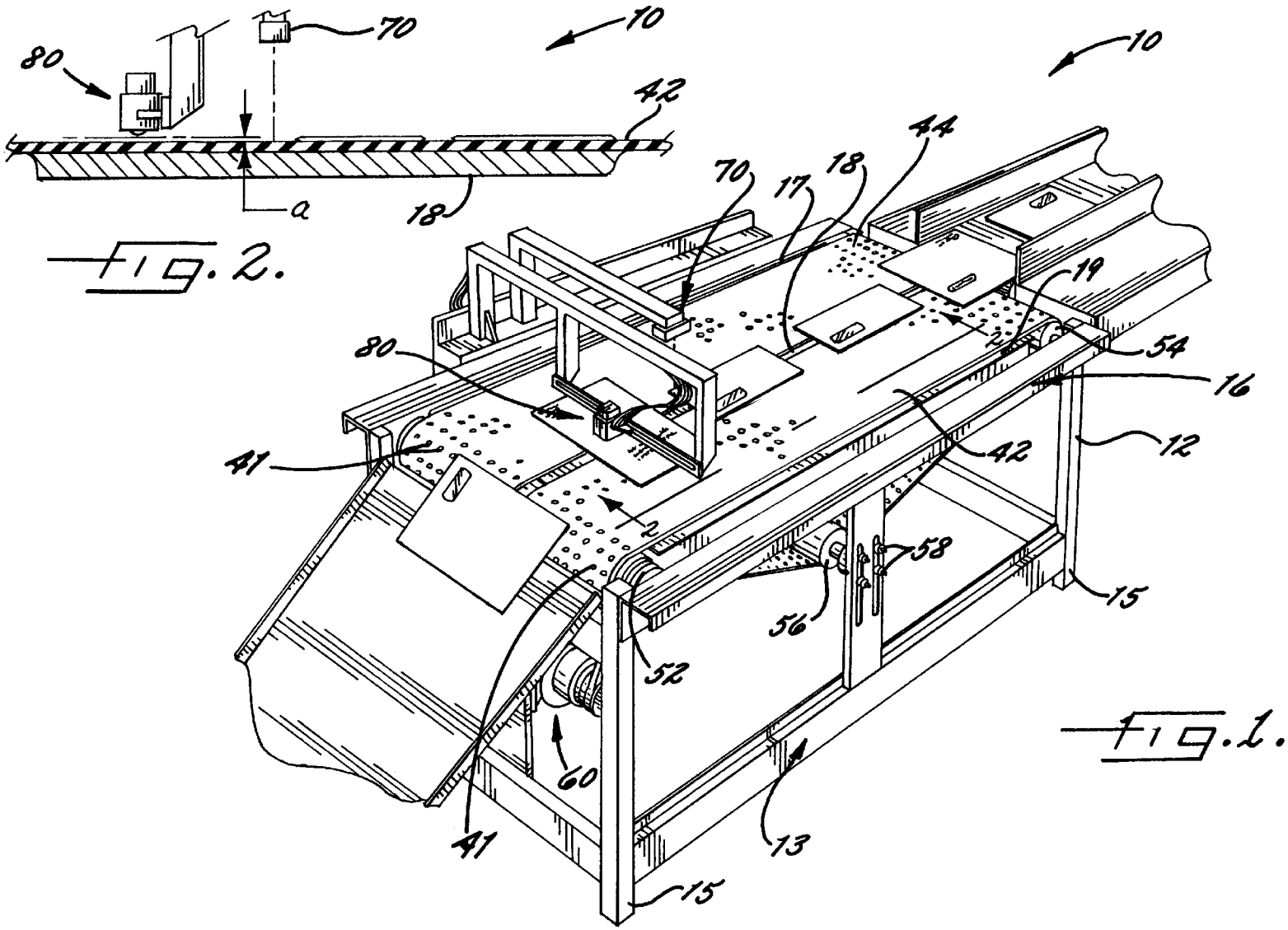
FIG. 1 is a perspective environmental view of a vacuum table conveying apparatus having a printer head and an article sensor mounted thereto according to the present invention.
FIG. 2 is a sectional view of a vacuum table conveying apparatus taken along line 2—2 of FIG. 1 according to the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

FIGS. 1–6 illustrate a vacuum table conveying apparatus 10 and associated methods according to the present invention. The apparatus 10 preferably includes a frame 12 and a vacuum chamber 20 positioned to extend along an upper portion of the frame 12. The frame 12 preferably includes at least two portions. A first portion 13 has a plurality of frame legs 15 and defines a main frame for providing structural support from a support surface, e.g., a floor. A second portion 16, i.e., upper portion, has a generally T-shape (see FIGS. 1, 3, and 7) and defines a gate for installing other portions of the apparatus 10 onto the frame 12, e.g., belts and/or rollers as described further herein below. The frame 12 is preferably extremely rigid and relatively light weight.

The vacuum table conveying apparatus 10 also has vacuum forming means, e.g., preferably provided by a vacuum source 30, positioned in fluid communication with, e.g., air flow, the vacuum chamber 20 to apply a low vacuum with a high volume of air to the vacuum chamber 20. The vacuum source 30 preferably is provided by a plurality of fans 32, 34, 36, e.g., three fans rotating counter-clockwise to form or create suction-type air flow, positioned in fluid communication with the vacuum chamber 20 for applying the low vacuum with a high volume of air, e.g., about 700 cubic feet of air flow per minute, to the vacuum chamber as understood by those skilled in the art. This low vacuum and high volume of air generates a strong adherence of article, e.g., paper or mail items, to the conveyor belts 42, 44 and a substantial increase in indifference to air leaks. The fans 32, 34, 36 are preferably positioned within fan mount openings extending along a lower portion or bottom of the vacuum chamber 20. The vacuum chamber 20 in combination with the fans 32, 34, 36 allows the vacuum force to be spread substantially uniformly throughout the upper surface of the chamber 20 and through openings 41 in the conveyor belts 42, 44. Additionally, as understood by those skilled in the art, notches or sawtooth cuts can be formed in the fan blades to decrease noise.

At least one vacuum conveyor belt 42, and more preferably at least two or a pair 42, 44 as illustrated, overlies the vacuum chamber 20. The belts 42, 44, in essence, form at least major portions of a top to the vacuum chamber 20. The pair of spaced-apart vacuum belts 42, 44 are each mounted to a plurality of spaced-apart rollers 52, 54, 56 and extend substantially parallel to each other in the same plane. Each of the vacuum conveyor belts 42, 44 preferably has a plurality of openings 41 extending through upper and lower surfaces thereof so that substantially uniform vacuum or vacuum force from the vacuum chamber 20 extends through the plurality of openings 41 and applies to articles, e.g., mail, mounted on the upper surface of the belt 42, 44.

As perhaps best illustrated in FIGS. 4–7, the plurality of spaced-apart rollers 52, 54, 56 are each preferably mounted to the frame 12, and the vacuum conveyor belts 42, 44 are each preferably mounted to and extending between the plurality of spaced-apart rollers and each overlie the vacuum chamber 20. A framed grid 25 is positioned within the vacuum chamber 20 between the plurality of fans 32, 34, 36 and the vacuum belts 42, 44 and is connected to the frame 12 to thereby provide additional underlying support to the belts 42, 44. The grid 25 advantageously can include adjustable or threaded cross-members which allow the tightening, adjusting, mounting, or other supporting operations to the grid 25 and the belts. When appropriate tension is within the belts 42, 44, the belts are preferably slightly spaced-apart from or separated from the grid 25. When operating, however, the vacuum from the vacuum source 30 pulls the belts into slight or supporting contact with the grid 25. Accordingly, the upper surfaces of the grid 25 are preferably low friction surfaces so that the belts during operation more easily slide across the surfaces.

Figure 3:
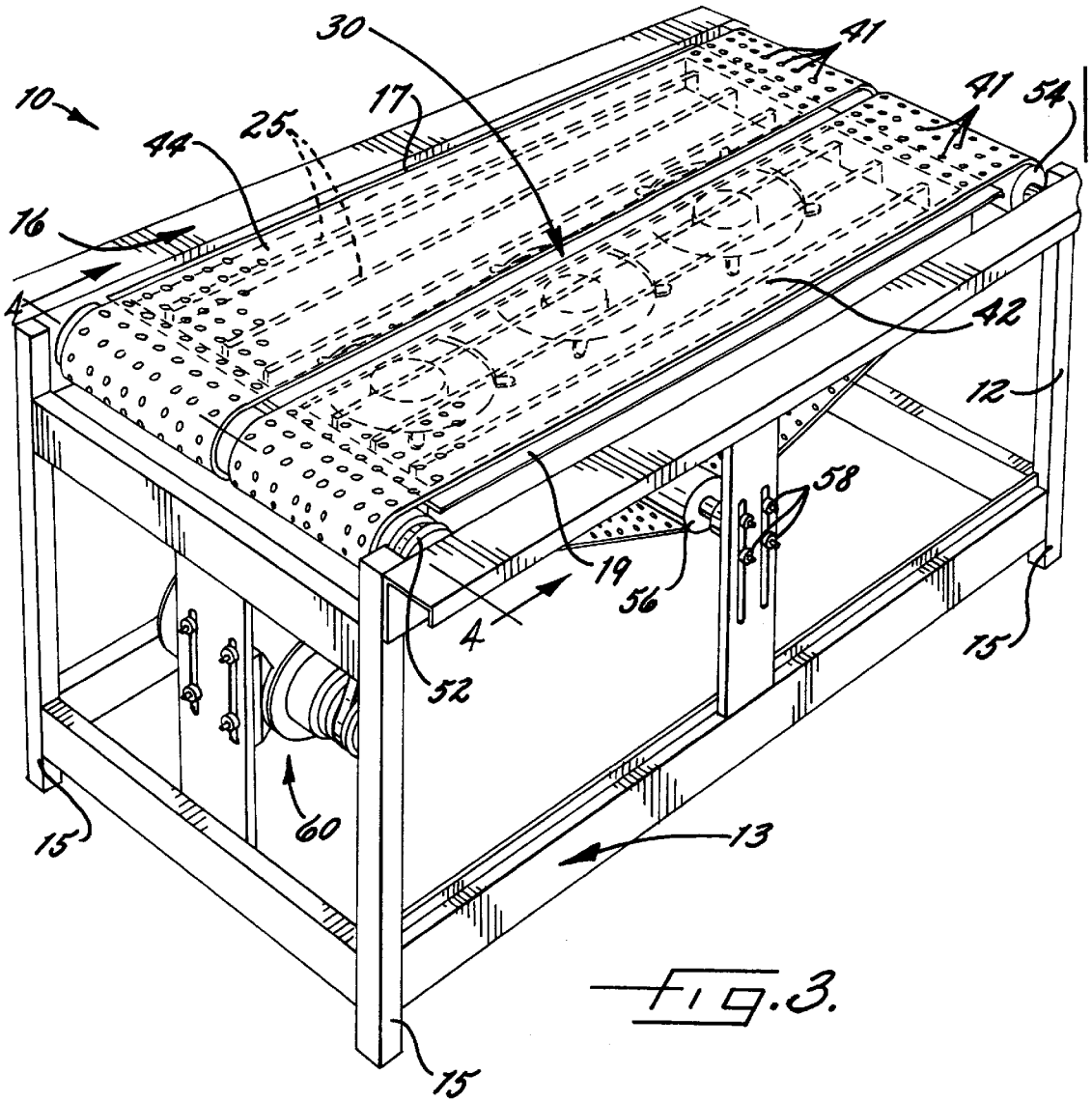
FIG. 3 is a perspective view of a vacuum table conveying apparatus according to the present invention.
Figures 5, 6:
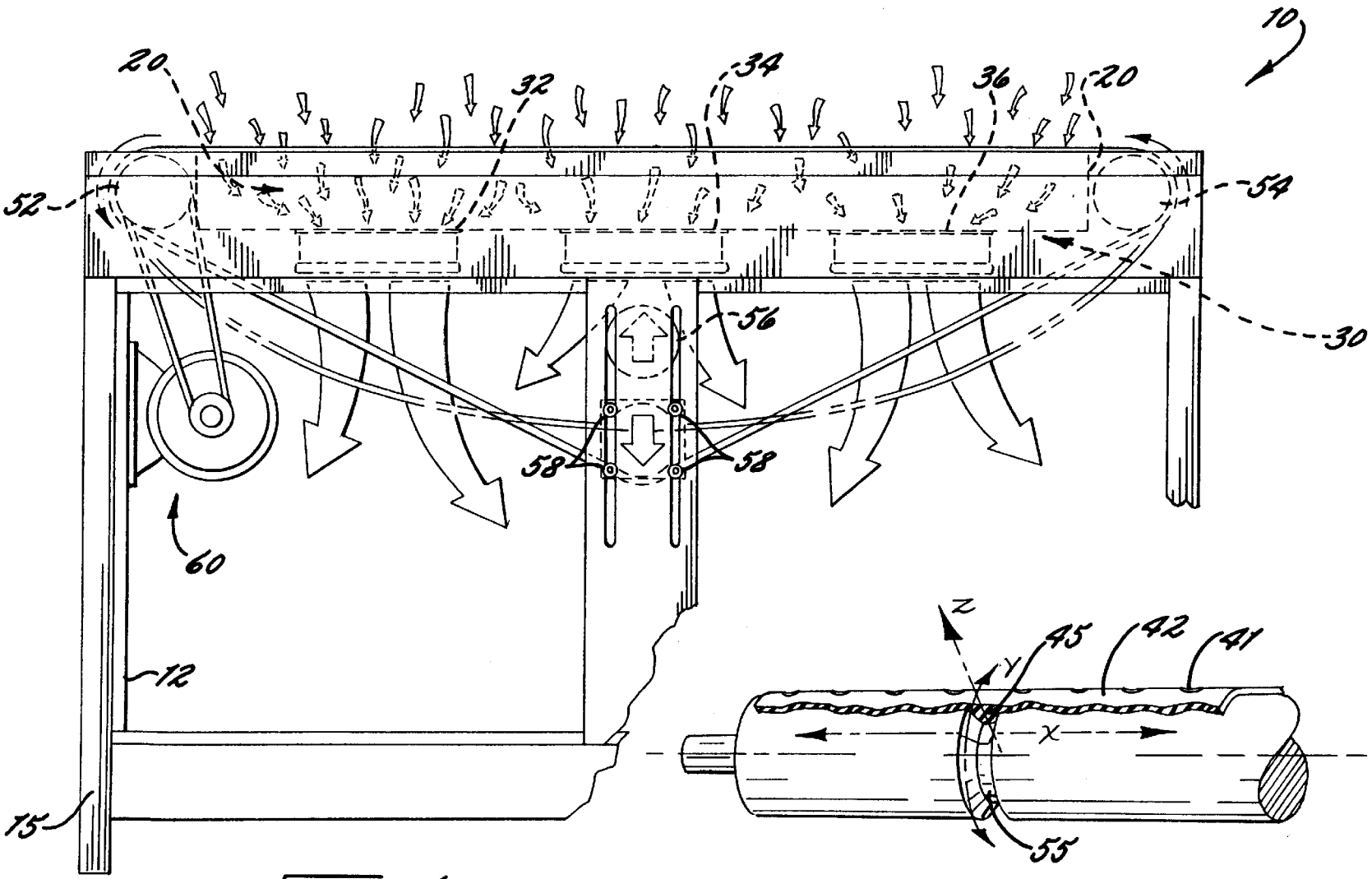
FIG. 5 is a fragmentary side elevational view of a vacuum table conveying apparatus according to the present invention.
FIG. 6 is a fragmentary perspective view of a vacuum table belt mounted to a roller of a vacuum table conveying apparatus according to the present invention.

The plurality of spaced-apart rollers 52, 54, 56 preferably include at least one roller 56 positioned to underlie the vacuum chamber 20, positioned at a lower elevation than at least two other rollers 52, 54 of the plurality of spaced-apart rollers 52, 54, 56, and being slidably connected to the frame 12 for adjusting tension within the vacuum conveyor belts 42, 44 (see FIGS. 1, 3, and 5). The at least one roller 56 at the lower elevation is preferably adjusted by loosening threaded fasteners 58, slidably positioning the roller 56 into a position where the tension of the belt or belts 42, 44 are at a desired location, and then re-tightening the threaded fasteners 58. The positioning of this roller 56 also advantageously provides a triangular path for the belts 42, 44 which allows plenty of room for the vacuum chamber 20 and the fans 32, 34, 36.

The vacuum table conveying apparatus 10 additionally preferably has at least one drive 60 connected to the frame 12 for driving the plurality of rollers 52, 54, 56 to thereby drive the belts 42, 44 mounted thereon and convey articles mounted on the belts 42, 44 in a predetermined direction of travel (i.e., see direction arrow of FIG. 1). The drive 60 preferably includes at least one motor, e.g., preferably including a drive shaft and a drive mechanism, e.g., a cam, a chain, or arm(s), for driving the rollers 52, 54, 56 as understood by those skilled in the art.

Figure 4:
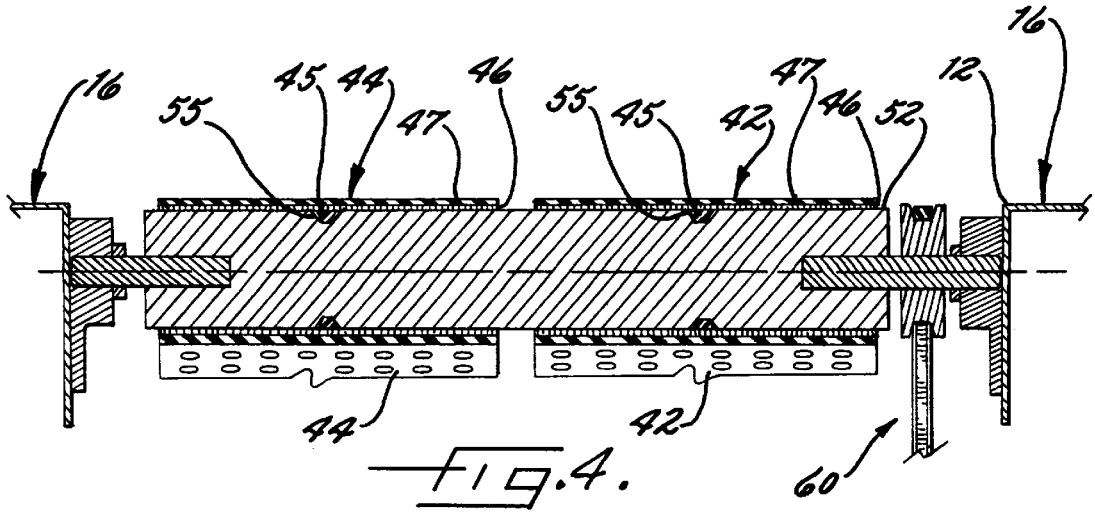
FIG. 4 is a sectional view of a vacuum table conveying apparatus taken along line 4—4 of FIG. 3 according to the present invention.
Figure 7:
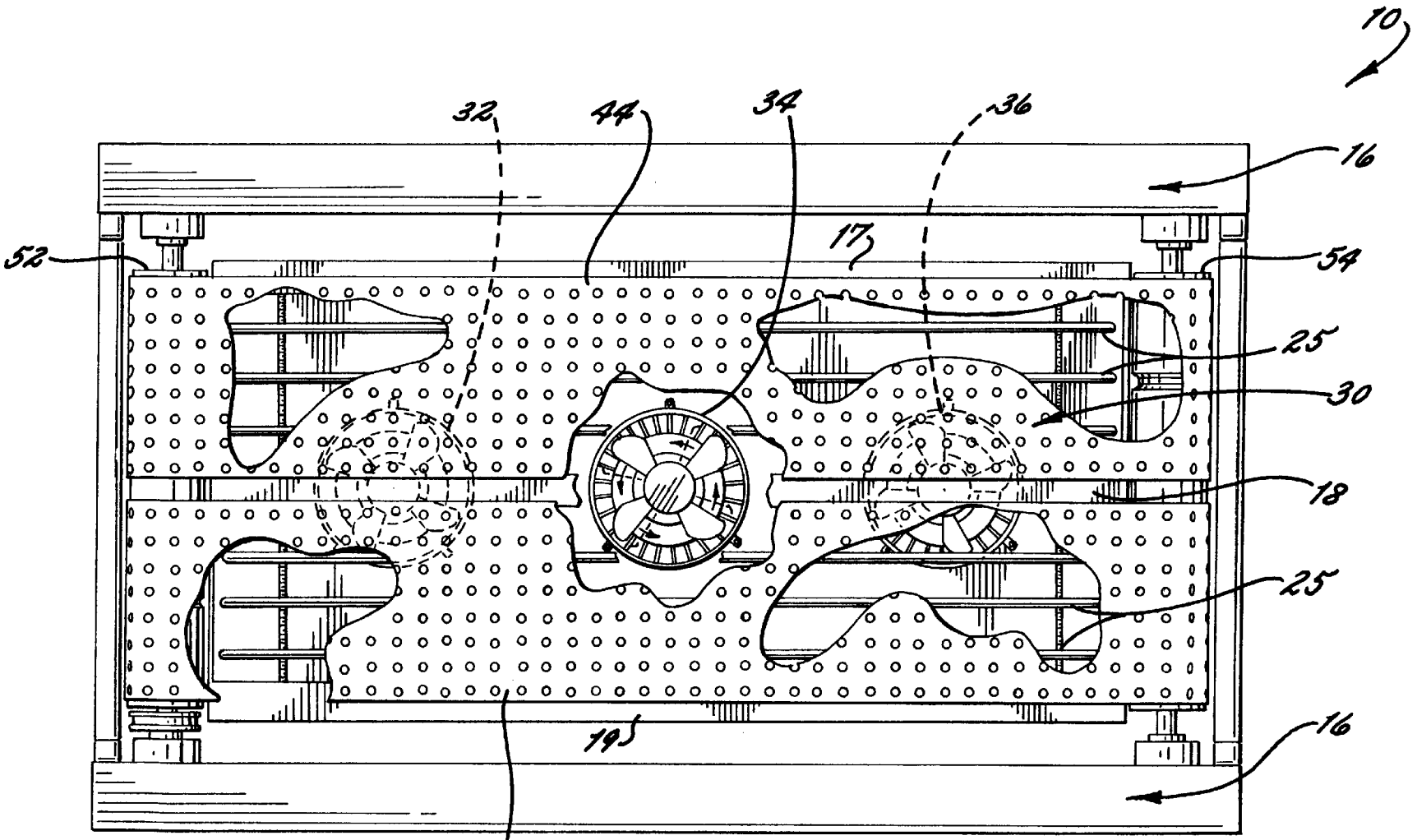
FIG. 7 is a fragmentary top view of a vacuum table conveying apparatus according to the present invention.

As perhaps best illustrated in FIGS. 4 and 6–7, for enhanced table platform stability, each of the plurality of spaced-apart rollers 52, 54, 56 preferably includes a roller channel 55 formed in a medial portion of an outer surface of the roller. Each of the vacuum belts 42, 44, in turn, preferably includes a belt stability protrusion 45 extending outwardly from a medial portion of a lower surface of the vacuum conveyor belt 42, 44 and positioned within each of the roller channels 55 to thereby provide enhanced stability in the vacuum conveyor belt 42, 44 when being driven by the plurality of rollers 52, 54, 56.

In contrast to conventional vacuum tables, which use several narrow belts, the apparatus 10 preferably has two relatively wide belts 42, 44 to enhance the ability to provide a substantially flat surface. Narrow belts also provide only a single row of openings. These wide belts 42, 44 of the present invention have a pattern of a plurality of openings 41 in both directions.

As perhaps best illustrated in FIG. 4, the vacuum table conveyor belt 42, 44 is preferably formed by a combination of a first low friction web material layer 46, a second plastic material layer 47 overlying the first low friction web material, and a belt stability protrusion 45 connected to and extending outwardly from a medial portion of the first low friction web material layer 46. This first layer 46 is also preferably formed of a plastic material and is preferably bonded or formed together such as with an adhesive or welded, e.g., heat or RF welded, to the second layer 47. The belt stability protrusion 45 is preferably positioned to abuttingly contact a drive roller, e.g., preferably each of rollers 52, 54, 56, and preferably has peripheries having a vertical sectional view thereof which define a substantially frustoconical shape or another substantially V-shape (see FIG. 4). The first and second layers 46, 47 also each include a plurality of coaxially aligned openings 41 extending therethrough which allow the vacuum from the plurality of fans 32, 34, 36 to draw and hold articles onto the belts 42, 44.

Also, the frame 12 of the vacuum table conveying apparatus also advantageously has an elongate frame member 18 positioned in the spaced-apart region between the pair of spaced-apart vacuum belts. The elongate frame member 18 is preferably formed of metal and preferably extends substantially the lengthwise extent of each of the upper conveying surfaces of the pair of spaced-apart vacuum belts 42, 44. The frame 12 preferably also has other supporting elongate members 17, 19 which support the peripheries of the belts. In essence, in total, if only one belt is needed, then two elongate support members can be used. If three belts are needed, then four elongate support members can be used. The elongate support members are preferably one more than the needed or desired belts so as to provide peripheral support for the belt(s).

Although not require, if printing or other operations are desired to be performed in conjunction with the use of the apparatus 10, then sensors or other detectors can advantageously be used with the apparatus for sensing or detecting the articles on the apparatus 10. In the example or embodiment shown for example, at least one sensor 70, e.g., a photocell or photodetector, is mounted adjacent the frame 12 for sensing the presence of articles positioned on the vacuum belts 42, 44. The elongate frame member 18, in turn, additionally preferably has a reflective upper surface to enhance sensing of the articles, e.g., black, white, or other various colors, when positioned on the pair of spaced-apart conveying belts 42, 44. A printer head 80, e.g., an inkjet printer head, can also be associated with or mounted to the frame 12 and is positioned closely adjacent the upper surface of the vacuum conveyor belts 42, 44 for printing high resolution indicia on a surface of an article positioned on the belts 42, 44 responsive to the sensing of the presence of articles on the belts 42, 44. The sensor 70 preferably provides electrical signals to a controller (not shown), e.g., a microprocessor or micro-controller, as understood by those skilled in the art. The controller then communicates with or sends command signals to the printer for activation of the printer head. The controller can also be used to control the drive speed of the drive motor for the rollers 52, 54, 56. The apparatus 10, for example, can advantageously be used for high speed transport and printing applications such as labels or other indicia on paper or mail items. For example, the belt speed can advantageously be adjusted from about 80 feet per minute to about 750 feet per minute. Although this is not to be construed as a limit on speed capabilities of the apparatus 10, this does provide a wide range of speed capabilities for various types of printer heads. It should be understood by those skilled in the art that the apparatus 10 has higher speed capabilities as well.

As shown in FIGS. 1–7, the present invention also includes a method of conveying articles. The method preferably includes providing a low vacuum and high volume air source 30 in fluid communication with a vacuum chamber 20, positioning at least one conveyor belt 42, 44 having a plurality of openings 41 extending therethrough to overlie the vacuum chamber 20 and in fluid communication with the vacuum source 30, and positioning a plurality of articles on the at least one conveying belt 42, 44 to be held in position by the vacuum applied through the plurality of openings 41 from the vacuum chamber 20.

This method can also advantageously include driving the at least one conveying belt 42, 44 in a predetermined direction, adjusting the tension in the at least one conveyor belt 42, 44 prior to the step of driving the at least one conveyor belt 42, 44, and stabilizing the at least one conveyor belt 42, 44 to prevent slidable motion of the at least one conveyor belt 42, 44 in at least two planes, e.g., X, Y, and Z directions (see FIG. 6). The stabilizing step preferably includes providing a plurality of spaced-apart rollers 52, 54, 56 each having a channel 55 extending through a medial portion thereof, and the at least one conveyor belt 42, 44 preferably includes a belt stability protrusion 45 extending outwardly from a lower surface thereof and positioned within the channel 55 of each of the plurality of rollers 52, 54, 56 to thereby stabilize the belt and inhibit slidable motion of the belt in three planes, e.g., as illustrated by the X, Y, and Z directional arrows of FIG. 6.

As perhaps best shown in FIGS. 1–2 and 6–7, the present invention further provides a method of printing on conveyed articles. This method preferably includes providing a low vacuum and high volume air source 30 in fluid communication with a vacuum chamber 20, positioning at least one substantially flat conveyor belt 42, 44 having a plurality of openings 41 extending therethrough to overlie the vacuum chamber 20 and in fluid communication therewith, positioning a plurality of articles on the at least one conveying belt to be held in position by the vacuum applied through the plurality of openings 41 from the vacuum chamber 20, driving the at least one conveying belt 42, 44 in a predetermined direction, sensing the presence of articles positioned on the at least once conveyor belt 42, 44, and positioning a head 80 of a printer closely adjacent an upper surface of the substantially flat conveyor belt 42, 44.

This method can further advantageously include conveying the plurality of articles between the printer head 80 and the upper surface of the conveyor belt 42, 44 and printing indicia on each of the plurality of articles conveyed therebetween responsive to the sense presence of an article. This method still can further include stabilizing the at least one conveyor belt 42, 44 to prevent slidable motion of the at least one conveyor belt in at least two planes. The stabilizing step preferably includes providing a plurality of spaced-apart rollers 52, 54, 56 each having a channel 55 extending through a medial portion thereof, and the at least one conveyor belt 42, 44 preferably includes a belt stability protrusion 45 extending outwardly from a lower surface thereof and positioned within the channel 55 of each of the plurality of rollers 52, 54, 56 to thereby stabilize the belt 42, 44 and inhibit, e.g., prevent, slidable motion of the belt 42, 44 in three planes. Tension in the at least one conveyor belt 42, 44 can also advantageously be adjusted prior to the driving step according to the methods of the present invention (see FIGS. 3 and 5).

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. A vacuum table conveying apparatus comprising:

a frame;

a vacuum chamber positioned to extend along an upper portion of the frame;

a plurality of fans positioned in fluid communication with said vacuum chamber for applying a low vacuum with a high volume of air of up to about 700 cubic feet per minute for retaining articles, such as pieces of mail, to said vacuum chamber;

a plurality of spaced-apart rollers mounted to said frame;

at least one vacuum belt mounted to and extending between said plurality of spaced-apart rollers and overlying said vacuum chamber, the at least one vacuum belt having a plurality of openings extending through upper and lower surfaces thereof so that vacuum from said vacuum chamber extends through the plurality of openings and applies to articles, such as pieces of mail, mounted on the upper surface of the at least one vacuum belt; and at least one drive connected to said frame for driving the plurality of rollers to thereby drive the at least one vacuum belt mounted thereon and convey articles mounted on the at least one vacuum belt.

2. An apparatus as defined in claim 1, further comprising a framed grid positioned within said vacuum chamber between said plurality of fans and said at least one vacuum belt and connected to said frame to thereby provide additional support to the at least one belt.

3. An apparatus as defined in claim 1, wherein each of said plurality of spaced-apart rollers includes a roller channel formed in an outer surface of the roller, and wherein said at least one vacuum belt includes a belt stability protrusion extending outwardly from a medial portion of a lower surface of said at least one vacuum belt and positioned within each of the roller channels to thereby provide enhanced stability in said at least one vacuum belt when being driven by said plurality of rollers.

4. An apparatus as defined in claim 1, wherein the plurality of spaced-apart rollers include at least one roller positioned to underlie said vacuum chamber, positioned at a lower elevation than at least two other rollers of the plurality of spaced-apart rollers, and being slidably connected to said frame for adjusting tension within the at least one vacuum belt.

5. An apparatus as defined in claim 1, wherein the at least one vacuum belt comprises a pair of spaced-apart vacuum belts mounted to said plurality of rollers and extending substantially parallel to each other in the same plane.

6. An apparatus as defined in claim 5, wherein said frame includes an elongate frame member positioned in the spaced-apart region between said pair of spaced-apart vacuum belts, the elongate frame member extending substantially the lengthwise extent of each of the upper conveying surfaces of said pair of spaced-apart vacuum belts.

7. An apparatus as defined in claim 6, further comprising at least one sensor mounted adjacent said frame for sensing the presence of articles positioned on the at least one vacuum belt, and wherein said elongate frame member has a reflective upper surface to enhance sensing of the articles when positioned on the pair of spaced-apart conveying belts.

8. An apparatus as defined in claim 1, further comprising a printer head associated with said frame and positioned closely adjacent the upper surface of the at least one vacuum belt for printing high resolution indicia on a surface of an article positioned on the at least one vacuum belt.

9. An apparatus as defined in claim 1, wherein said frame includes at least two portions, a first portion having a plurality of frame legs and defining a main frame and a second portion having a generally T-shape and defining a gate for installing the at least one belt onto said plurality of rollers.

10. An apparatus as defined in claim 1, wherein the drive includes at least one motor positioned to drive the plurality of rollers, and wherein said at least one vacuum belt comprises a first low-friction web material layer and a second plastic material layer overlying said first low-friction web material layer.

11. A vacuum table conveying apparatus comprising:

a frame;

a vacuum chamber positioned to extend along an upper portion of the frame;

vacuum forming fans positioned in fluid communication with said vacuum chamber for applying a low vacuum with a high volume of air of up to about 700 cubic feet per minute for retaining articles, such as pieces of mail, to said vacuum chamber; and at least one vacuum belt overlying said vacuum chamber, the at least one vacuum belt having a plurality of openings extending through upper and lower surfaces thereof so that vacuum from said vacuum chamber extends through the plurality of openings and applies to articles mounted on the upper surface of the at least one vacuum belt.

12. An apparatus as defined in claim 11, further comprising a plurality of spaced-apart rollers having said at least one vacuum belt mounted thereto and driving means connected to said frame for driving the plurality of rollers to thereby drive the at least one vacuum belt mounted thereon and convey articles mounted on the at least one vacuum belt.

13. An apparatus as defined in claim 12, further comprising a framed grid positioned within said vacuum chamber between said vacuum forming means and said at least one vacuum belt and connected to said frame to thereby provide additional support to the at least one belt.

14. An apparatus as defined in claim 13, wherein each of said plurality of spaced-apart rollers includes a roller channel formed in an outer surface of the roller, and wherein said at least one vacuum belt includes a belt stability protrusion extending outwardly from a medial portion of a lower surface of said at least one vacuum belt and positioned within each of the roller channels to thereby provide enhanced stability in said at least one vacuum belt when being driven by said plurality of rollers.

15. An apparatus as defined in claim 14, wherein the plurality of spaced-apart rollers include at least one roller positioned to underlie said vacuum chamber, positioned at a lower elevation than at least two other rollers of the plurality of spaced-apart rollers, and being slidably connected to said frame for adjusting tension within the at least one vacuum belt.

16. An apparatus as defined in claim 15, wherein the at least one vacuum belt comprises a pair of spaced-apart vacuum belts mounted to said plurality of rollers and extending substantially parallel to each other in the same plane.

17. An apparatus as defined in claim 16, wherein said frame includes an elongate frame member positioned in the spaced-apart region between said pair of spaced-apart vacuum belts, the elongate frame member extending substantially the lengthwise extent of each of the upper conveying surfaces of said pair of spaced-apart vacuum belts.

18. An apparatus as defined in claim 17, further comprising at least one sensor mounted adjacent said frame for sensing the presence of articles positioned on the at least one vacuum belt, and wherein said elongate frame member has a reflective upper surface to enhance sensing of the articles when positioned on the pair of spaced-apart conveying belts.

19. An apparatus as defined in claim 18, further comprising a printer head associated with said frame and positioned closely adjacent the upper surface of the at least one vacuum belt for printing high resolution indicia on a surface of an article positioned on the at least one vacuum belt.

20. An apparatus as defined in claim 19, wherein said frame includes at least two portions, a first portion having a plurality of frame legs and defining a main frame and a second portion having a generally T-shape and defining a gate for installing the at least one belt onto said plurality of rollers.

21. An apparatus as defined in claim 20, wherein said driving means includes at least one motor positioned to drive the plurality of rollers, and wherein said at least one vacuum belt comprises a first low-friction web material layer and a second plastic material layer overlying said first low-friction web material layer.

22. A vacuum table conveyor belt comprising:

a first low friction web material layer;

a second plastic material layer overlying said first low friction web material;

a belt stability protrusion connected to and extending outwardly from a medial portion of said first low friction web material layer and positioned to abuttingly contact a drive roller wherein the peripheries of a vertical sectional view of said belt stability protrusion define a substantially frusto-conical shape.

23. A conveyor belt as defined in claim 22, wherein said first and second layers each include a plurality of coaxially aligned openings extending therethrough.

24. A conveyor belt as defined in claim 23, wherein said first layer is also formed of a plastic material and being bonded to said second layer.

25. A method of conveying articles comprising:

providing a low vacuum and high volume air source in fluid communication with a vacuum chamber and formed from a plurality of fans that create a vacuum air flow of up to about 700 cubic feet per minute for retaining articles, such as pieces of mail;

positioning at least one conveyor belt having a plurality of openings extending therethrough to overlie the vacuum chamber and positioned in fluid communication therewith; and positioning a plurality of articles on the at least one conveying belt to be held in position by the vacuum applied through the plurality of openings from the vacuum chamber.

26. A method as defined in claim 25, further comprising driving the at least one conveying belt in a predetermined direction.

27. A method as defined in claim 25, further comprising adjusting the tension in the at least one conveyor belt prior to the step of driving the at least one conveyor belt.

28. A method as defined in claim 25, further comprising stabilizing the at least one conveyor belt to prevent slidable motion of the at least one conveyor belt in at least two planes.

29. A method as defined in claim 28, wherein the stabilizing step includes providing a plurality of spaced-apart rollers each having a channel extending through a medial portion thereof, and wherein the at least one conveyor belt includes a belt stability protrusion extending outwardly from a lower surface thereof and positioned within the channel of each of the plurality of rollers to thereby stabilize the belt and inhibit slidable motion of the belt in three planes.

30. A method of printing on conveyed articles comprising:

providing a low vacuum and high volume air source in fluid communication with a vacuum chamber and formed from a plurality of fans that create a vacuum air flow up to about 700 cubic feet per minute for retaining articles, such as pieces of mail;

positioning at least one substantially flat conveyor belt having a plurality of openings extending therethrough to overlie the vacuum chamber and positioned in fluid communication therewith;

positioning a plurality of articles on the at least one conveying belt to be held in position by the vacuum applied through the plurality of openings from the vacuum chamber;

driving the at least one conveying belt in a predetermined direction;

sensing the presence of articles positioned on the at least once conveyor belt; and positioning a head of a printer closely adjacent an upper surface of the substantially flat conveyor belt.

31. A method as defined in claim 30, further comprising conveying the plurality of articles between the printer head and the upper surface of the conveyor belt and printing indicia on each of the plurality of articles conveyed therebetween.

32. A method as defined in claim 31, further comprising stabilizing the at least one conveyor belt to prevent slidable motion of the at least one conveyor belt in at least two planes.

33. A method as defined in claim 32, wherein the stabilizing step includes providing a plurality of spaced-apart rollers each having a channel extending through a medial portion thereof, and wherein the at least one conveyor belt includes a belt stability protrusion extending outwardly from a lower surface thereof and positioned within the channel of each of the plurality of rollers to thereby stabilize the belt and inhibit slidable motion of the belt in three planes.

34. A method as defined in claim 33, further comprising adjusting the tension in the at least one conveyor belt prior to the step of driving the at least one conveyor belt.

* * * * *

UNITED STATES PATENT AND TRADEMARK OFFICE

CERTIFICATE OF CORRECTION

PATENT NO. : 6,216,848 B1
DATED : April 17, 2001
INVENTOR(S) : Zens

It is certified that error appears in the above-identified patent and that said Letters Patent is hereby corrected as shown below:

Column 1,
Line 16, delete "know" substitute -- known --

Signed and Sealed this

Eleventh Day of December, 2001

*Attest:*

Nicholas P. Godici

NICHOLAS P. GODICI
*Acting Director of the United States Patent and Trademark Office*

*Attesting Officer*